US006157124A

United States Patent [19]

Wakasono

[11] Patent Number: 6,157,124

[45] Date of Patent: Dec. 5, 2000

[54] CATHODE RAY TUBE WITH SPECIFICALLY SHAPED INSIDE PICTURE AREA

[75] Inventor: Hiromi Wakasono, Takarazuka, Japan

[73] Assignee: Matsushita Electronics Corporation, Japan

[21] Appl. No.: 09/173,621

[22] Filed: Oct. 16, 1998

[30] Foreign Application Priority Data

Oct. 31, 1997 [JP] Japan ..... 9-300516

[51] Int. Cl.[7] ..... H01J 29/10

[52] U.S. Cl. ..... 313/461

[58] Field of Search ..... 313/461, 462, 313/463, 464, 466, 473

[56] References Cited

FOREIGN PATENT DOCUMENTS

| | | |
|---|---|---|
| 0146926 A2 | 7/1985 | European Pat. Off. . |
| 0448401 A2 | 9/1991 | European Pat. Off. . |
| 0512613 A1 | 11/1992 | European Pat. Off. . |
| 5-83585 | 4/1993 | Japan . |

OTHER PUBLICATIONS

Patent Abstracts of Japan, Publication No. 05083585A, published Apr. 4, 1993.

*Primary Examiner*—Vip Patel

*Attorney, Agent, or Firm*—Rosenthal & Osha L.L.P.

[57] ABSTRACT

An effective picture area A, displaying an image on the inside of a face panel, is curved and has no inflection points. An origin O marks the center of the effective picture area A on the inside of the face panel. The x-axis passes the origin O and is parallel to the long sides $X_a$ of the effective picture area. The y-axis passes the origin O and is parallel to the short sides $Y_a$ of the effective picture area. The z-axis passes the origin O and is parallel to the tube axis. Using a Cartesian coordinate system of the axes x, y, and z, the saggital height Z of any point (x, y, z) on the inner surface of the face panel 4 from the origin O in the direction of the tube is given by $Z=a_1x^2+a_2x^4+a_3y^2+a_4x^2y^2+a_5x^4y^2+a_6y^4+a_7x^2y^4$, which describes a curved surface without inflection points. Thus, a cathode ray tube device can be provided, wherein the distortion amount of an inner pincushion distortion in the effective picture area can be decreased without an increase of the deflection power and device costs.

10 Claims, 6 Drawing Sheets

CATHODE RAY TUBE WITH SPECIFICALLY SHAPED INSIDE PICTURE AREA

FIELD OF THE INVENTION

The present invention relates to a cathode ray tube device for use in, for example, a television receiver or a display monitor.

BACKGROUND OF THE INVENTION

When an electron beam in a regular cathode ray tube device is scanned in horizontal direction, the distance from the deflection center to a central portion of the effective picture area differs from the distance to a short side portion of the effective picture area. Because of this difference, the scanning distances of the electron beam for the same deflection angle are different. Usually, an S-correction is performed to correct the resulting image distortion. In an S-correction, the slanted portions of the saw-tooth-shaped deflection current waveform are formed into an S-form.

The amount of the S-orrection is set to a value where the east-west pincushion distortion at the short side of the effective picture area, that is, at the left and right edges of the effective picture area, becomes zero. In recent years, however, ever larger cathode ray tube devices and ever flatter cathode ray tube device screens have brought about an even larger difference between the distance from the electron beam deflection center to a central portion of the effective picture area and the distance from the electron beam deflection center to a short side portion of the effective picture area. Thus, as is illustrated with vertical lines in FIG. 6(*a*), inner pincushion distortion 1*a* and 1*b* occurs in the right and left intermediate portions located between the short sides $Y_a$ of the effective picture area A and the y-axis, which is parallel to the short sides $Y_a$ and passes through the center of the effective picture area A. As illustrated with horizontal lines in FIG. 6(*b*), inner pincushion distortion 1*e* and 1*f* occurs in upper and lower intermediate portions located between the long sides $X_a$ of the effective picture area A and the x-axis, which is parallel to the long sides $X_a$ and passes through the center of the effective picture area A. Particularly when using the cathode ray tube device for applications such as CAD, this causes straight to lines bend into curved lines, and circles to bend into ellipses, which may be very irritating and obstruct work efficiency.

In conventional cathode ray tube devices such as disclosed, for example in Publication of Unexamined Japanese Patent Appilication No. Hei 5-83585, the deflection circuit comprises an additional circuit such as a modulation transforming circuit. This circuit overlaps a horizontal signal with a parabola wave signal that is synchronized with a vertical signal, so that the distortion amount δ' of the vertical inner pincushion distortion 1*a* and 1*b* is decreased.

However, in such conventional cathode ray tube devices, which have a deflection circuit comprising an additional circuit such as a modulation transforming circuit, the necessary deflection power is about 10% higher than in cathode ray tube devices without such additional circuits. Moreover, the cost of such a device will increase by the cost of the additional circuit.

The present invention has been developed to overcome the problems of the prior art. It is a purpose of the present invention to provide a cathode ray tube device in which the amount of inner pincushion distortion in the effective picture area is decreased without an increase of the deflection power and device costs.

SUMMARY OF THE INVENTION

A cathode ray tube device in accordance with an embodiment of the present invention comprises a glass bulb having a substantially rectangular face panel, a cone portion, and a neck portion;

a phosphorous screen formed on an inside surface of the face panel;

an electron gun inside the neck portion;

a deflection coil provided around a peripheral surface portion of the cone portion and the neck portion; and a deflection circuit for applying a deflection current to the deflection coil, wherein an effective picture area formed on the inside of said face panel is concave and shaped in a manner that an amount of inner pincushion distortion is decreased. In such a cathode ray tube device, an amount of inner pincushion distortion can be suppressed without providing the deflection circuit with a further additional circuit, such as a modulation transforming circuit. Thus, an inexpensive cathode ray tube device with decreased deflection power can be realized.

In the cathode ray tube device according to an embodiment of the present invention, the effective picture area has no inflection points, and a quotient $R_t/R_h$ of a curvature radius $R_t$ of a cross-section through a long side of the effective picture area and a curvature radius $R_h$ of a cross-section that is parallel to the long side and includes a center (origin) of the effective picture area is in a range of 1 to 1.9. When using this embodiment for applications such as CAD, straight lines on the effective picture area do not bend into curved lines, and circles do not bend into ellipses. As a result, a cathode ray tube device that does not impede work efficiency can be realized. In an embodiment of the invention, δ and σ are defined as $$\delta = \left(7.7920\times10^{-3} - \frac{2.9428\times10^{-2} * D}{R_d}\right) * \tan\theta_D \times 100 \text{ and} \tag{7}$$

$$\sigma = \frac{D*(1-0.75^2)*\tan\theta_D}{4R_h*(1+\alpha^2)*\alpha}\times100, \text{ and } R_t/R_h \text{ satisfies} \tag{8}$$

$$\frac{\sigma}{\sigma-\delta+0.24} < \frac{R_t}{R_h} < \frac{\sigma}{\sigma-\delta-0.24}, \text{ wherein} \tag{9}$$

D is the distance from the center of the effective picture area (origin) to a diagonal edge of the effective picture area;

H is one half of the long side of the effective picture area;

V is one half of the short side of the effective picture area;

α is the aspect ratio V/H of the effective picture area;

$R_d$ is a curvature radius of a cross-section through a diagonal axis of the effective picture area, and $\theta_D$ is one half of the deflection angle.

In this embodiment, $R_d$ may be equal to $R_h$.

In the cathode ray tube device according to an embodiment of the present invention, the effective picture area has no inflection points, and a quotient $R_s/R_v$ of a curvature radius $R_s$ of a cross-section through a short side of the effective picture area and a curvature radius of a cross-section that is parallel to the short side and includes a center (origin) of the effective picture area is in a range from 1 to 3.4. When using this embodiment for applications such as CAD, straight lines on the effective picture area do not bend into curved lines, and circles do not bend into ellipses. As a result, a cathode ray tube device that does not impede work efficiency can be realized.

In an embodiment of the invention, $\epsilon$ and $\tau$ are defined as $$\varepsilon = \left(4.8000\times10^{-3} - \frac{1.74000\times10^{-2}*D}{R_d}\right)*\tan\theta_D\times100 \text{ and} \tag{10}$$

$$\tau = \frac{D*(1-0.75^2)*\tan\theta_D}{4R_v*(1+\alpha^{-2})*\alpha^{-1}}\times100, \text{ and } R_s/R_v \text{ satisfies} \tag{11}$$

$$\frac{\tau}{\tau-\varepsilon+0.14} < \frac{R_s}{R_v} < \frac{\tau}{\tau-\varepsilon-0.14}, \text{ wherein} \tag{12}$$

D is the distance from the center of the effective picture area (origin) to a diagonal edge of the effective picture area;

H is one half of the long side of the effective picture area;

V is one half of the short side of the effective picture area;

$\alpha$ is the aspect ratio V/H of the effective picture area;

$R_d$ is a curvature radius of a cross-section through a diagonal axis of the effective picture area, and $\theta_D$ is one half of the deflection angle.

In this embodiment, $R_d$ may be equal to $R_v$.

DESCRIPTION OF THE PREFERRED EMBODIMENTS

The following is a description of the preferred embodiments of the present invention, with reference to the accompanying drawings.

Figure 1:
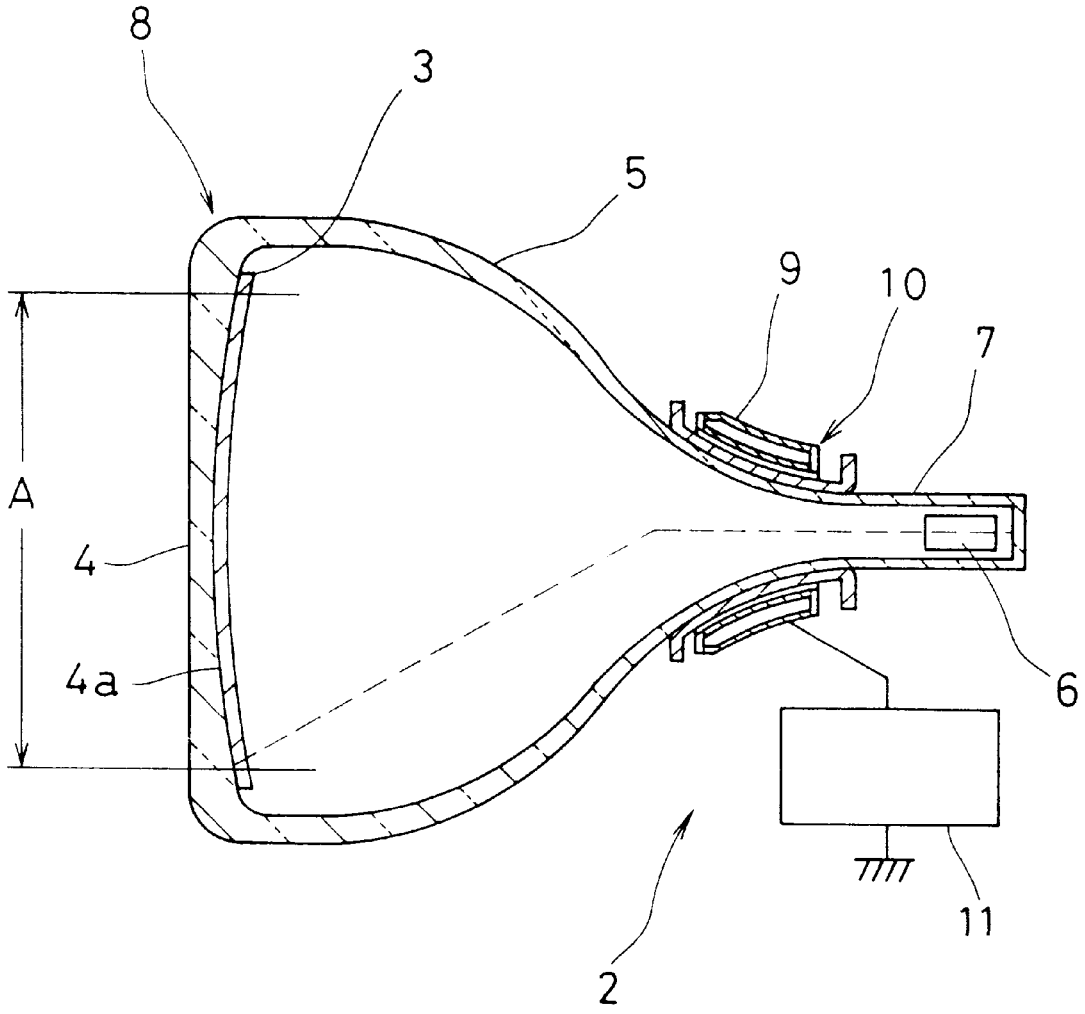
FIG. 1 is a cross-sectional view illustrating a cathode ray tube device according to an embodiment of the present invention.
Figure 2:
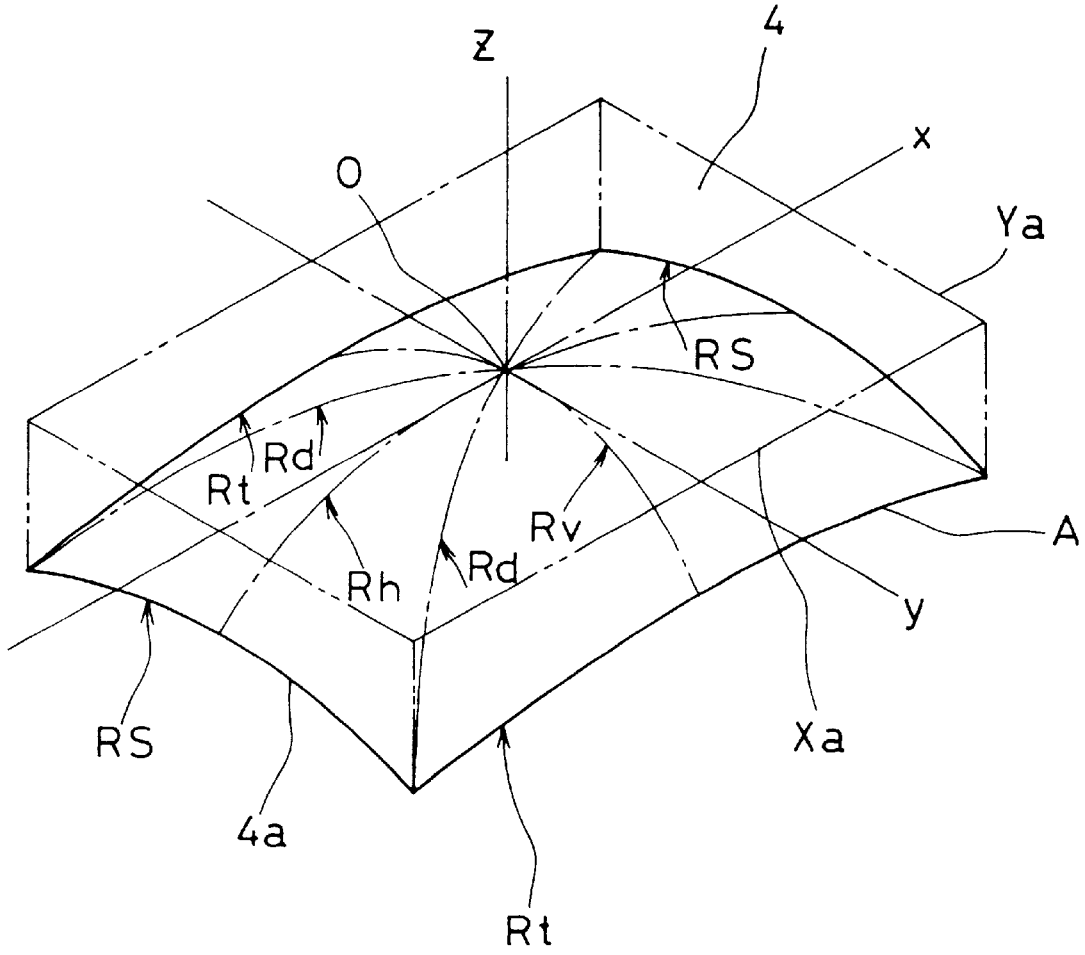
FIG. 2 is a perspective view illustrating the shape of the effective picture area inside the face panel of a cathode ray tube device according to an embodiment of the present invention.

FIG. 1 is a cross-sectional view of a cathode ray tube device according to an embodiment of the present invention. As is shown in FIG. 1, a cathode ray tube device 2 in accordance with this embodiment comprises a glass bulb 8 having a substantially rectangular face panel 4, a cone portion 5, and a neck portion 7. A phosphorous screen 3 is formed on an inside surface of the face panel 4. An electron gun 6 is inside the neck portion 7 and a deflection device 10 having a deflection coil 9 is provided around a peripheral surface portion of the cone portion 5 and the neck portion 7. A deflection circuit 11 for applying a deflection current to the deflection coil 9 is also provided. The effective picture area A, which displays an image on the inside of the face panel 4, is formed on a concave surface 4*a*. Therefore, the distortion amount of the inner pincushion distortion can be decreased. In other words, the effective picture area A is formed as a curved surface without inflection points, as shown by the solid line in FIG. 2. In FIG. 2, the origin O marks the center of the effective picture area A on the inside of the face panel 4. The x-axis passes the origin O and is parallel to the long sides $X_a$. The y-axis passes the origin O and is parallel to the short sides $Y_a$. The z-axis passes the origin O and is parallel to the tube axis. Using a Cartesian coordinate system of the axes x, y, and z, the saggital height Z of any point (x, y, z) on the inner surface of the face panel 4 from the origin O in tube direction is given by $Z=a_1x^2+a_2x^4+a_3y^2+a_4x^2y^2+a_5x^4y^2+a_6y^4+a_7x^2y^4$, which describes a curved surface without inflection points.

Figure 4:
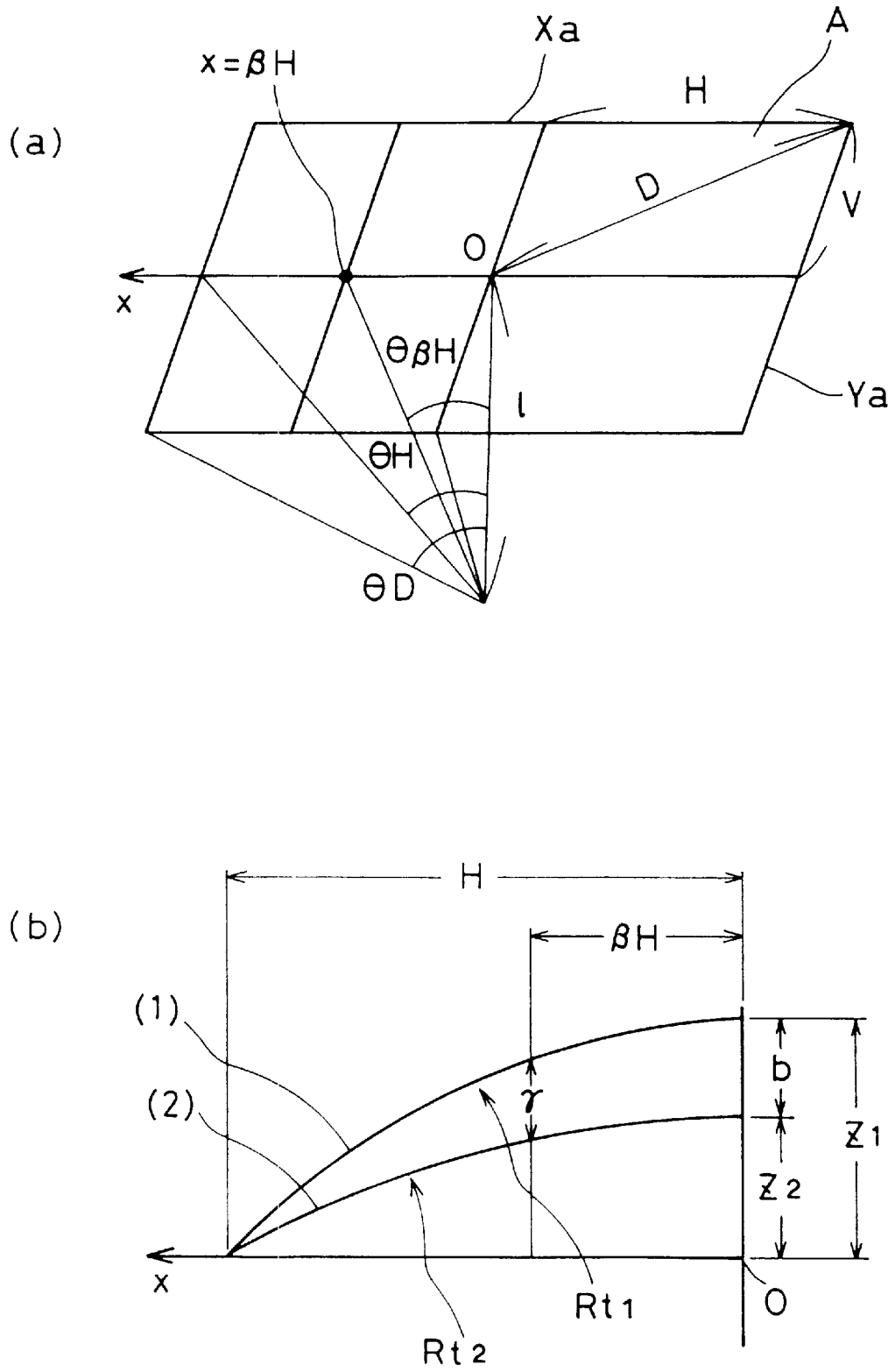
FIGS. 4(*a*) and (*b*) are diagrams illustrating how to set the shape of the effective picture area inside the face panel of a cathode ray tube device according to an embodiment to the present invention.

In FIG. 4(*a*), D is the distance from the center (origin O) of the effective picture area A to a diagonal edge of the effective picture area A, 1 is the distance from the origin O to the deflection center and $\theta_D$ corresponds to one half of the deflection angle (deflection half angle). Also, H corresponds to one half of the long side $X_a$ of the effective picture area A, V corresponds to one half of the short side $Y_a$ of the effective picture area A, and $\alpha$ is the aspect ratio V/H of the effective picture area A. As illustrated in FIG. 2, $R_h$ is the curvature radius of a cross-section of the effective picture area A that is parallel to the long sides $X_a$ and includes the origin O (referred to below as the "curvature radius on the horizontal axis"). $R_t$ is the curvature radius of a cross-section through the long side $X_a$ of the effective picture area A (referred to below as the "curvature radius on the long side"). $R_v$ is the curvature radius of a cross-section of the effective picture area A that is parallel to the short sides $Y_a$ and includes the origin O (referred to below as the "curvature radius on the vertical axis"). $R_s$ is the curvature radius of a cross-section through the short side $X_a$ of the effective picture area A (referred to below as "curvature radius on the short side"). $R_d$ is the curvature radius of a cross-section through a diagonal axis of the effective picture area A.

As becomes clear from FIG. 4(*a*), 1 is given by $$l = \frac{D}{\tan\theta_D}. \tag{13}$$

Moreover, the horizontal component $\theta_H$ of the deflection half angle $\theta_D$ is given by $$\theta_H = \tan^{-1}\frac{\beta*H}{l}. \tag{14}$$

Moreover, the incident angle $\theta_{\beta H}$ at $x=\beta H$ is given by $$\theta_{\beta H} = \tan^{-1}\frac{\beta*H}{l}. \tag{15}$$

Inserting Equation 13 into Equation 15 yields $$\theta_{\beta H} = \tan^{-1}\frac{\beta*\tan\theta_D}{\sqrt{1+\alpha^2}} \tag{16}$$

FIG. 4(*b*) shows cross-sections of effective picture areas A along the long side $X_a$. In FIG. 4(*b*), (1) is the cross-section of a conventional curved surface with a curvature radius $R_{t1}$, and (2) is the cross-section of a curved surface according to an embodiment with a curvature radius $R_{t2}$.

The saggital heights $Z_1$ and $Z_2$ shown in FIG. 4(*b*) are given by $$Z_1 = R_{t1} - \sqrt{R_{t1}^2 - H^2} \text{ and} \tag{17}$$

$$Z_2 = R_{t2} - \sqrt{R_{t2}^2 - H^2}. \tag{18}$$

When approximated by a quadratic equation, the saggital height of the curves (1) and (2) can be expressed by $$Z_{Rt1} = \frac{Z_1}{H^2} * x^2 \text{ and} \tag{19}$$

$$Z_{Rt2} = \frac{Z_2}{H^2} * x^2. \tag{20}$$

Expressing the difference between the saggital height $Z_1$ and the saggital height $Z_2$ as $$b = Z_1 - Z_2, \tag{21}$$

the difference γ between the saggital height of the curve (1) and the saggital height of the curve (2) at x=βH can be expressed by $$\gamma = b * (1 - \beta^2). \tag{22}$$

With $R_{t2}=kR_{t1}$, the difference b between the saggital height $Z_1$ and the saggital height $Z_2$ can be approximated using the Equations (17), (18) and (21) as $$b = \frac{H^2}{2R_{t1}}\left(1 - \frac{1}{k}\right). \tag{23}$$

Using the Equations (16), (22) and (23), and replacing $R_{t1}$ with $R_h$, the correction amount $\sigma_{\beta H}$ of the vertical inner pincushion distortion at x=βH can be expressed as $$\sigma_{\beta H} = \frac{D^2 * (1 - \beta^2) * \tan\theta_D}{2R_h * (1 + \alpha^2)^{3/2}}\left(1 - \frac{1}{k}\right). \tag{24}$$

When Equation (24) is normalized to the length 2V of the short side $Y_a$ of the effective picture area A, the correction ratio $\sigma'_{\beta H}$ of the vertical inner pincushion distortion is given as $$\sigma'_{\beta H} = \frac{D * (1 - \beta^2) * \tan\theta_D}{4R_h * (1 + \alpha^2)\alpha}\left(1 - \frac{1}{k}\right) \times 100. \tag{25}$$

The original distortion amount δ' of the vertical inner pincushion distortion near x=(¾)H before application of the present embodiment can be expressed by the empirical formula $$\delta' = 2V * \left(A - \frac{B * D}{R_d}\right) * \tan\theta_D, \tag{26}$$

which has been derived from measurements of different kinds of cathode ray tube devices with a curved effective picture area. In Equation (26), $A=7.7920\times10^{-3}$ and $B=2.9428\times10^{-2}$.

The rest distortion amount ρ of the vertical inner pincushion distortion can be expressed by $$\rho = \delta' - \sigma_{\beta H}. \tag{27}$$

When the standardized rest distortion amount ρ of the vertical inner pincushion distortion is L %, then $$-L < \frac{\rho}{2V} \times 100 < L \tag{28}$$

can be used to define a range for k. Therefore, β is set to β=¾, and δ and σ are defined as $$\delta = \left(A - \frac{B * D}{R_d}\right) * \tan\theta_D \times 100 \text{ and} \tag{29}$$

$$\sigma = \frac{D * (1 - 0.75^2) * \tan\theta_D}{4R_h * (1 + \alpha^2) * \alpha} \times 100. \tag{30}$$

If Equation (28) is transformed using the Equations (24), (26), and (27), then a range for $k=R_{t2}/R_{t1}=R_t/R_h$ can be defined as $$\frac{\sigma}{\sigma - \delta + L} < k < \frac{\sigma}{\sigma - \delta - L}. \tag{31}$$

$k=R_{t2}/R_{t1}=R_t/R_h$ is adjusted to the range given by Equation 31, so that the tolerance threshold L (this value is determined by a sensory test with the actual display) of the vertical inner pincushion distortion ratio (rest distortion amount ρ of the vertical inner pincushion distortion (1*a*, 1*b*)/half length of the short side $Y_a$ of the effective picture area A) becomes ±0.24%.

The previous explanations pertained to an improvement of the vertical inner pincushion distortion. The following explains an embodiment for the improvement of the horizontal inner pincushion distortion.

The improvement of the horizontal inner pincushion distortion is similar to the improvement of the vertical inner pincushion distortion. Thus, it can easily be explained reversing vertical and horizontal. In other words, V and H, $R_t$ and $R_s$, $R_h$ and $R_v$ are swapped. α is replaced by 1/α, δ by ε, and σ by τ. Further, the coefficients A and B are replaced with the coefficients A' and B' for an original distortion amount δ of the horizontal pincushion distortion near y=(¾)V before application of the present embodiment. This results in $$\varepsilon = \left(A' - \frac{B' * D}{R_d}\right) * \tan\theta_D \times 100, \tag{32}$$

$$\tau = \frac{D * (1 - 0.75^2) * \tan\theta_D}{4R_v * (1 + \alpha^{-2}) * \alpha^{-1}} \times 100 \text{ and} \tag{33}$$

$$\frac{\tau}{\tau - \varepsilon + L} < k' < \frac{\tau}{\tau - \varepsilon - L}. \tag{34}$$

$k'=R_s/R_v$ is adjusted to the range given by Equation 34, so that the tolerance threshold L (this value is determined by a sensory test with the actual display) of the horizontal inner pincushion distortion ratio (rest distortion amount ρ of the horizontal inner pincushion distortion (1*e*, 1*f*)/half length of the long side $X_a$ of the effective picture area A) becomes ±0.14%.

The shape of the effective picture area A on the inside of the face panel 4 in the present embodiment was expressed by the function $Z=a_1x^2+a_2x^4+a_4y^2+a_4x^2y^2+a_5x^4y^2+a_6y^4+a_7x^2y^4$. However, the present invention is not limited to shapes that satisfy this function, and the shape of the effective picture area A on the inside of the face panel 4 can be any curved surface that decreases the inner pincushion distortion.

The following explains the merits of using a cathode ray tube device with the above-explained structure.

Figure 3:
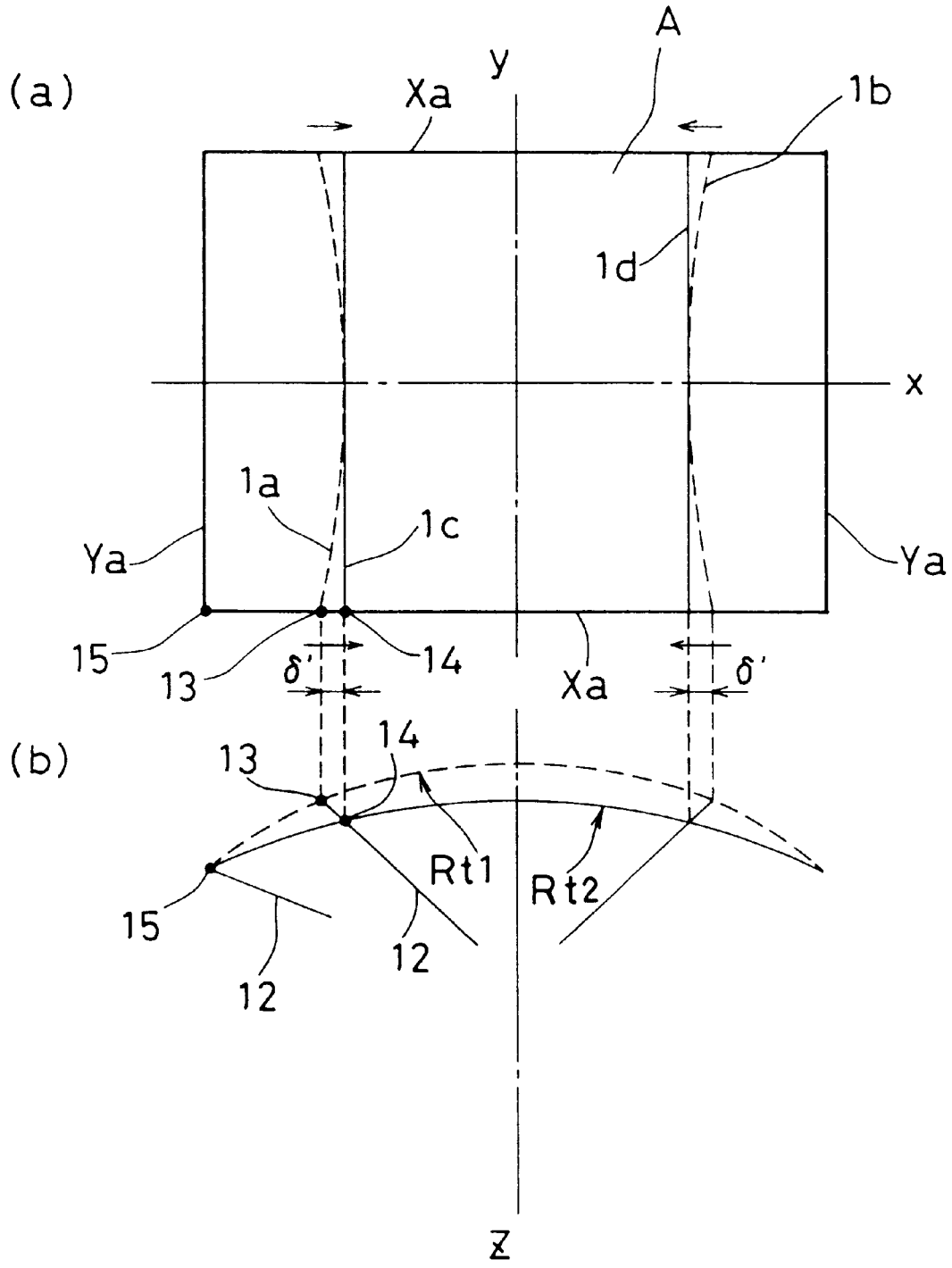
FIGS. 3(*a*) and (*b*) are diagrams illustrating the suppression of the inner pincushion distortion in a cathode ray tube device according to an embodiment of the present invention.
Figure 5:
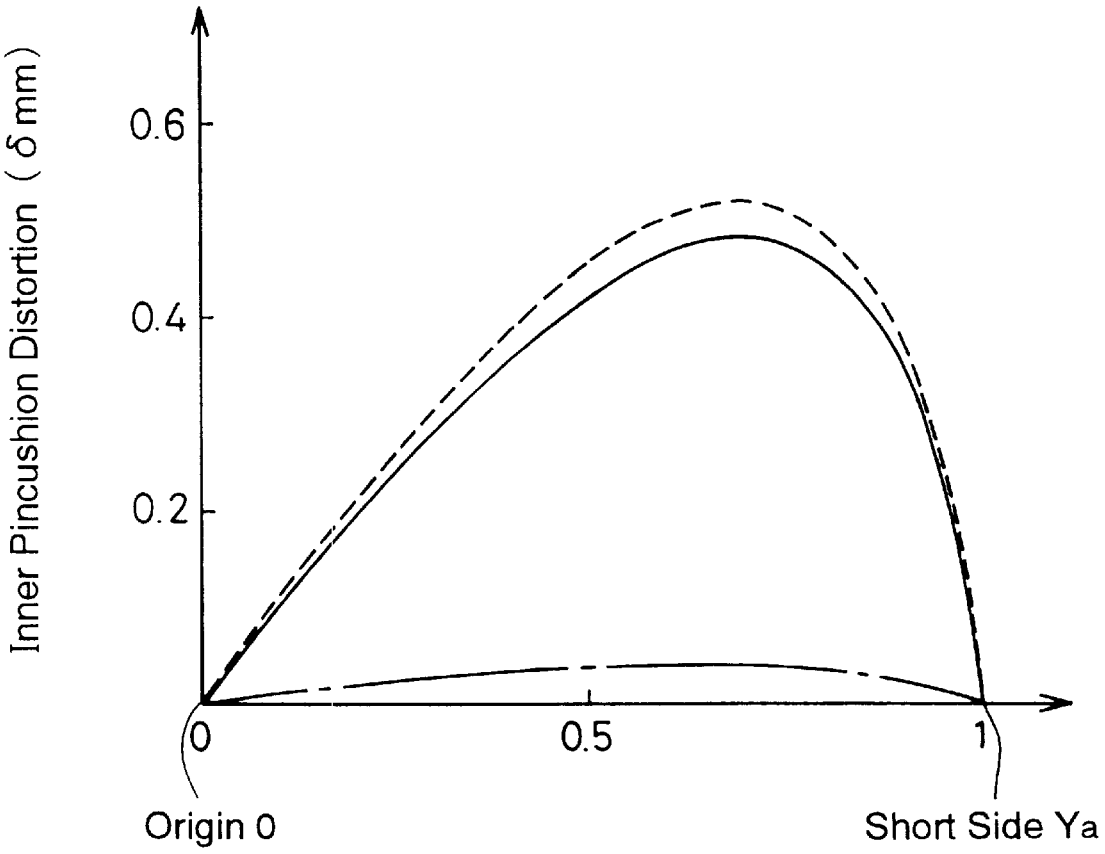
FIG. 5 is a graph of the distribution of pincushion distortion in a cathode ray tube according to an embodiment of the present invention.
Figure 6:
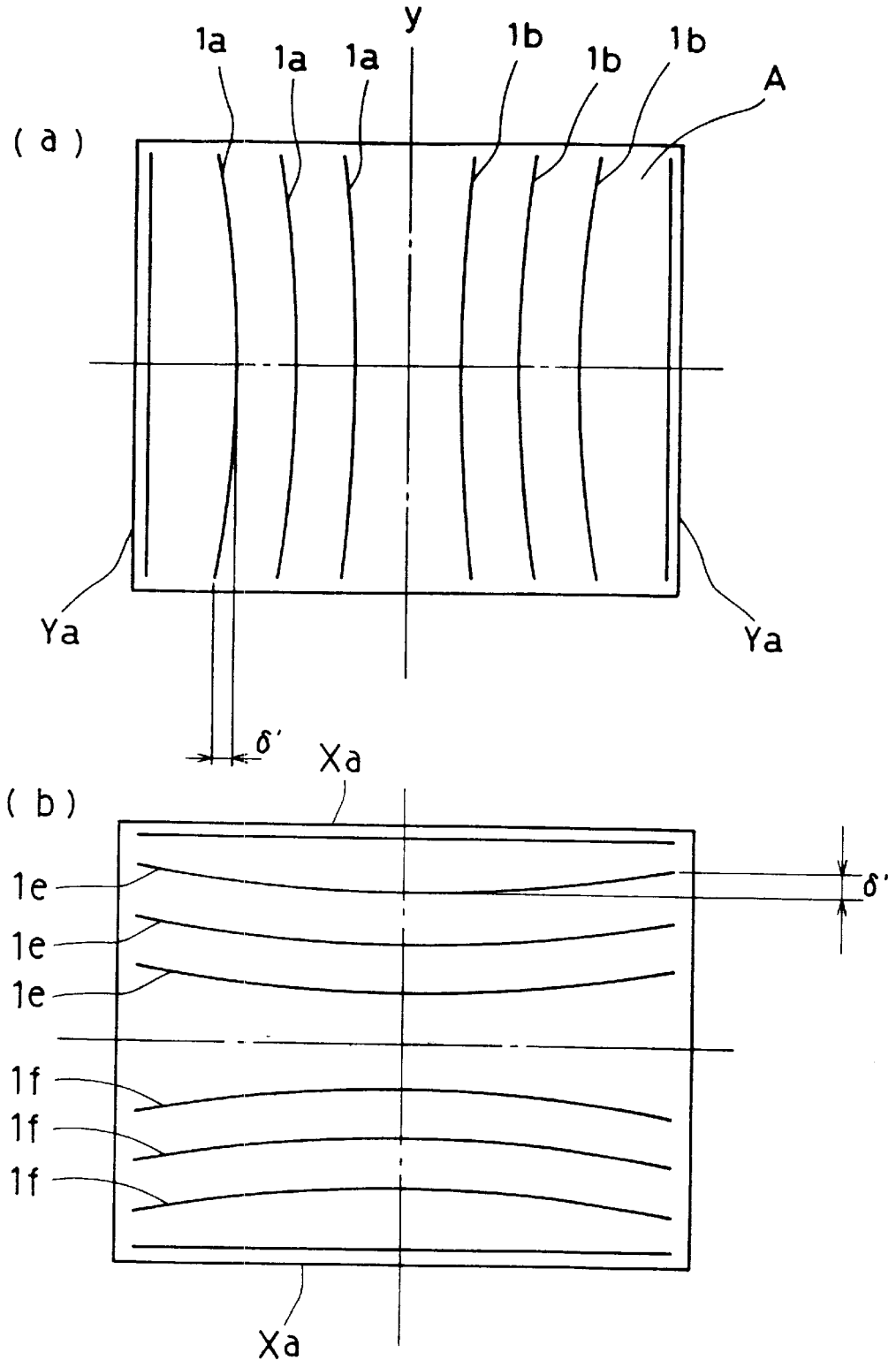
FIG. 6 (PRIOR ART)
FIG. 6 is a diagram illustrating inner pincushion distortion in a cathode ray tube device according to an embodiment to the present invention.

Conventionally, the amount of the S-correction is set to a value where the east-west pincushion distortion at the short sides $Y_a$ of the effective picture area becomes zero. For example, the effective picture area A inside the face panel is formed into a curved surface with a curvature radius on the horizontal axis and a curvature radius on the long side that both are $R_{t1}$, as shown by the broken line in FIG. 3(*b*), which gives rise to vertical inner pincushion distortion 1*a* and 1*b*. The distortion amount δ' of the vertical inner pincushion distortion 1*a* and 1*b* from the center (y-axis) of the effective picture area A to the short side $Y_a$ underlies the distribution shown by the broken line in FIG. 5. Moreover, in accordance with an embodiment of the invention, the effective picture area A inside the face panel 4 is formed to a curved surface with a curvature radius on the horizontal axis that is $R_{t1}$ and a curvature radius on the long side that is $R_{t2}$ ($>R_{t1}$) as shown by the solid line in FIG. 3(*b*) in a manner that the distortion amount δ' of the vertical inner pincushion distortions 1*a* and 1*b* can be decreased. Therefore, a curvature difference due to changing the curvature radius on the long side, in an intermediate portion of the long side $X_a$ between the y-axis and the short axis $Y_a$, from the conventional $R_1$ to $R_2$ ($>R_1$) displaces a conventional end-point 13 of the electron beam 12 to an end-point 14, as shown in FIG. 3(*b*). Thus, the conventional vertical inner pincushion distortion 1*a* and 1*b* is corrected into the vertical inner pincushion distortion 1*c* and 1*d*. The solid line in FIG. 5 indicates the amount by which the vertical inner pincushion distortion is corrected. The distortion amount δ' of the vertical inner pincushion distortion 1*a* and 1*b* between the center (y-axis) of the effective picture area A and the short side $Y_a$ is corrected into the distribution shown by the long-and-short-dash line in FIG. 5. There is no curvature difference at the edges 15 of the long end $X_a$, so that the east-west pincushion distortion on the short sides $Y_a$ becomes zero.

As has been shown above, a distortion amount δ' of the vertical inner pincushion distortion 1*a* and 1*b* can be decreased without providing the deflection circuit with an additional circuit, such as a modulation transforming circuit, as was necessary in the prior art. Thus, an inexpensive cathode ray tube device with decreased deflection power can be realized.

The concave surface 4*a* of the face panel 4 is formed as a curved surface without inflection points. Furthermore, $k=R_{t2}/R_{t1}=R_t/R_h$ is adjusted to the range given by Equation 31, so that the tolerance threshold L of the vertical inner pincushion distortion ratio (rest distortion amount ρ of the vertical inner pincushion distortion/length of the short side $Y_a$ of the effective picture area A) becomes ±0.24%. Therefore, when using the cathode ray tube device for applications such as CAD, straight lines on the effective picture area A do not bend into curved lines, and circles do not bend into ellipses. As a result, a cathode ray tube device that does not impede work efficiency can be realized.

Comparing the correction of the horizontal inner pincushion distortion to that of the vertical inner pincushion distortion, it results that the only difference is the swapping of vertical and horizontal. Thus, by exchanging the horizontal with the vertical axis and the long side with the short side, a similar effect can be attained.

Consequently, a distortion amount δ' of the horizontal inner pincushion distortion 1*e* and 1*f* can be decreased without providing the deflection circuit with an additional circuit, such as a modulation transforming circuit, as was necessary in the prior art. Thus, an inexpensive cathode ray tube device with decreased deflection power can be realized.

As noted above, the concave surface 4*a* of the face panel 4 is formed as a curved surface without inflection points. Moreover, $k=R_s/R_v$ is adjusted to the range given by Equation 34, so that the tolerance threshold L of the horizontal inner pincushion distortion ratio (rest distortion amount ρ of the horizontal inner pincushion distortion (1*e*, 1*f*)/half length of the short side $Y_a$ of the effective picture area A) becomes ±0.14%. Therefore, when using the cathode ray tube device for applications such as CAD, straight lines on the effective picture area A do not bend into curved lines, and circles do not bend into ellipses. As a result, a cathode ray tube device that does not impede work efficiency can be realized.

The following is more detailed description of the preferred embodiments of the present invention, with reference to specific examples.

EXAMPLE 1

A 19" cathode ray tube device 2 in accordance with this example has the structure illustrated in FIG. 1. The saggital height Z of the effective picture area A on the inside of a face panel 4 of the cathode ray tube device 2 is defined by $Z=a_1x^2+a_2x^4+a_3y^2+a_4x^2y^2+a_5x_4y^2+a_6y^4+a_7x^2y^4$, with $a_1=4.0322\times10^{-4}$, $a_2=6.6465\times10^{-11}$, $a_3=5.9043\times10^{-4}$, $a_4=-5.4220\times10^{-9}$, $a_5=-1.2582\times10^{-15}$, $a_6=-4.4083\times10^{-9}$, and $a_7=1.3385\times10^{-13}$.

The curvature radius $R_d$ of a cross-section through a diagonal axis of the effective picture area A is 1240 mm, the curvature radius $R_h$ of the horizontal axis is 1240 mm, the curvature radius $R_v$ of the vertical axis is 990 mm, and the curvature radius $R_t$ of the long side is 1434 mm. Thus, $k=R_t/R_h$ becomes 1.16. This value is inside the range $1.02<k<1.34$ that results from inserting δ, σ and the tolerance threshold L=0.24% of the vertical inner pincushion distortion ratio into Equation 31. The values of δ, σ have been obtained by inserting D=228.6 mm, $R_d=R_h=1240$ mm, $\theta_D=50°$, and $\alpha=0.75$ into the Equations 29 and 30. The actual vertical inner pincushion distortion ratio is 0.02% and thus well within the standard range.

In this example, $R_d=R_h$ has been assumed when defining the shape of the effective picture area inside the face panel 4. However, $R_d$ and $R_h$ do not necessarily have to be equal, and a favorable effect can be anticipated even when they are different.

Moreover, the range for $k=R_t/R_h$ in this example was determined by calculation to be $1.02<k<1.34$. However, a range where the inner pincushion distortion is not problematic is $1<k<1.9$.

EXAMPLE 2

A 19" cathode ray tube device 2 in accordance with this example has the structure illustrated in FIG. 1. The saggital height Z of the effective picture area A on the inside of a face panel 4 of the cathode ray tube device 2 is defined by $Z=a_1x^2+a_2x^4+a_3y^2+a_4x^2y^2+a_5x^4y^2+a_6y^4+a_7x^2y^4$, with $a_1=4.716847\times10^{-4}$, $a_2=1.06943\times10^{-10}$, $a_3=4.032239\times10^{-4}$, $a_4=-3.482765\times10^{-9}$, $a_5=-2.085193\times10^{-15}$,
$a_6=-6.606631\times10^{-11}$, and
$a_7=-1.284873\times10^{-15}$.

The curvature radius $R_d$ of a cross-section through a diagonal axis of the effective picture area A is 1240 mm, the curvature radius $R_h$ of the horizontal axis is 1060 mm, the curvature radius $R_v$ of the vertical axis is 1240 mm, and the curvature radius $R_s$ of the short side is 1758 mm. Thus, $k'=R_s/R_v$ becomes 1.42. This value is inside the range $1.08<k'<2.03$ that results from inserting δ, σ and the tolerance threshold L=0.140% of the horizontal inner pincushion distortion ratio into Equation 31. The values of δ, σ have been obtained by inserting D=228.6 mm, $R_d=R_v=1240$ mm, $\theta_D=50°$, and $\alpha=0.75$ into the Equations 32 and 33. The actual horizontal inner pincushion distortion ratio is 0.01% and thus well within the standard range.

In this example, $R_d=R_v$ has been assumed when defining the shape of the effective picture area inside the face panel 4. However, $R_d$ and $R_h$ do not necessarily have to equal, and a favorable effect can be anticipated even when they are different.

Moreover, the range for $k'=R_s/R_v$ in this example was determined by calculation to be $1.08<k'<2.03$. However, a range where the inner pincushion distortion is not problematic is $1<k<3.4$.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A cathode ray tube device comprising a glass bulb having a substantially rectangular face panel, a cone portion, and a neck portion;

a phosphorous screen formed on an inside surface of the face panel;

an electron gun inside the neck portion;

a deflection coil provided around a peripheral surface portion of the cone portion and the neck portion;

a deflection circuit for applying a deflection current to the deflection coil, wherein an effective picture area formed on the inside of said face panel is concave, and the effective picture area has no inflection points; and wherein δ and σ are defined as $$\delta=\left(7.7920\times10^{-3}-\frac{2.9428\times10^{-2}*D}{R_d}\right)*\tan\theta_D\times100 \quad (1)$$

$$\sigma=\frac{D*(1-0.75^2)*\tan\theta_D}{4R_h*(1+\alpha^2)*\alpha}\times100,\ \text{and}\ R_t/R_h\ \text{satisfies} \quad (2)$$

$$\frac{\sigma}{\sigma-\delta+0.24}<\frac{R_t}{R_h}<\frac{\sigma}{\sigma-\delta-0.24},\ \text{wherein} \quad (3)$$

D is a distance from the center of the effective picture area (origin) to a diagonal edge of the effective picture area;

H is one half of a long side of the effective picture area;

V is one half of a short side of the effective picture area;

α is an aspect ratio V/H of the effective picture area;

$R_d$ is a curvature radius of a cross-section through a diagonal axis of the effective picture area; and $\theta_D$ is a deflection half angle.

2. The cathode ray tube device according to claim 1, wherein $R_d=R_h$.

3. A cathode ray tube device comprising a glass bulb having a substantially rectangular face panel, a cone portion, and a neck portion;

a phosphorous screen formed on an inside surface of the face panel;

an electron gun inside the neck portion;

a deflection coil provided around a peripheral surface portion of the cone portion and the neck portion;

a deflection circuit for applying a deflection current to the deflection coil, wherein an effective picture area formed on the inside of said face panel is concave, and the effective picture area has no inflection points; and wherein a quotient $R_t/R_h$ of a curvature radius $R_t$ of a cross-section through a long side of the effective picture area and a curvature radius $R_h$ of a cross-section that is parallel to the long side and includes a center (origin) of the effective picture area is in a range of 1 to 1.9.

4. The cathode ray tube device according to claim 3, wherein δ and σ are defined as $$\delta=\left(7.7920\times10^{-3}-\frac{2.9428\times10^{-2}*D}{R_d}\right)*\tan\theta_D\times100\ \text{and} \quad (1)$$

$$\sigma=\frac{D*(1-0.75^2)*\tan\theta_D}{4R_h*(1+\alpha^2)*\alpha}\times100,\ \text{and}\ R_t/R_h\ \text{satisfies} \quad (2)$$

$$\frac{\sigma}{\sigma-\delta+0.24}<\frac{R_t}{R_h}<\frac{\sigma}{\sigma-\delta-0.24},\ \text{wherein} \quad (3)$$

D is a distance from the center of the effective picture area (origin) to a diagonal edge of the effective picture area;

H is one half of a long side of the effective picture area;

V is one half of a short side of the effective picture area;

α is an aspect ratio V/H of the effective picture area;

$R_d$ is a curvature radius of a cross-section through a diagonal axis of the effective picture area, and $\theta_D$ is a deflection half angle.

5. The cathode ray tube device according to claim 4, wherein $R_d=R_h$.

6. A cathode ray tube device comprising a glass bulb having a substantially rectangular face panel, a cone portion, and a neck portion;

a phosphorous screen formed on an inside surface of the face panel;

an electron gun inside the neck portion;

a deflection coil provided around a peripheral surface portion of the cone portion and the neck portion;

a deflection circuit for applying a deflection current to the deflection coil, wherein an effective picture area formed on the inside of said face panel is concave, and the effective picture area has no inflection points; and wherein ε and τ are defined as $$\varepsilon = \left(4.8000\times10^{-3} - \frac{1.74000\times10^{-2}*D}{R_d}\right)*\tan\theta_D\times100 \quad (1)$$

$$\tau = \frac{D*(1-0.75^2)*\tan\theta_D}{4R_v*(1+\alpha^{-2})*\alpha^{-1}}\times100, \text{ and } R_s/R_v \text{ satisfies} \quad (2)$$

$$\frac{\tau}{\tau-\varepsilon+0.14} < \frac{R_s}{R_v} < \frac{\tau}{\tau-\varepsilon-0.14}, \text{ wherein} \quad (3)$$

D is a distance from the center of the effective picture area (origin) to a diagonal edge of the effective picture area;

H is one half of a long side of the effective picture area;

V is one half of a short side of the effective picture area;

α is an aspect ratio V/H of the effective picture area;

$R_d$ is a curvature radius of a cross-section through a diagonal axis of the effective picture area; and $\theta_D$ is a deflection half angle.

7. The cathode ray tube device according to claim 6, wherein $R_d$=$R_v$.

8. A cathode ray tube device comprising a glass bulb having a substantially rectangular face panel, a cone portion, and a neck portion;

a phosphorous screen formed on an inside surface of the face panel;

an electron gun inside the neck portion;

a deflection coil provided around a peripheral surface portion of the cone portion and the neck portion;

a deflection circuit for applying a deflection current to the deflection coil, wherein an effective picture area formed on the inside of said face panel is concave, and the effective picture area has no inflection points; and wherein ε and τ are defined as $$\varepsilon = \left(4.8000\times10^{-3} - \frac{1.74000\times10^{-2}*D}{R_d}\right)*\tan\theta_D\times100 \text{ and} \quad (4)$$

-continued $$\tau = \frac{D*(1-0.75^2)*\tan\theta_D}{4R_v*(1+\alpha^{-2})*\alpha^{-1}}\times100, \text{ and } R_s/R_v \text{ satisfies} \quad (5)$$

$$\frac{\tau}{\tau-\varepsilon+0.14} < \frac{R_s}{R_v} < \frac{\tau}{\tau-\varepsilon-0.14}, \text{ wherein} \quad (6)$$

D is a distance from the center of the effective picture area (origin) to a diagonal edge of the effective picture area;

H is one half of a long side of the effective picture area;

V is one half of a short side of the effective picture area;

α is an aspect ratio V/H of the effective picture area;

$R_d$ is a curvature radius of a cross-section through a diagonal axis of the effective picture area; and $\theta_D$ is a deflection half angle.

9. The cathode ray tube device according to claim 8, wherein ε and τ are defined as $$\varepsilon = \left(4.8000\times10^{-3} - \frac{1.74000\times10^{-2}*D}{R_d}\right)*\tan\theta_D\times100 \text{ and} \quad (4)$$

$$\tau = \frac{D*(1-0.75^2)*\tan\theta_D}{4R_v*(1+\alpha^{-2})*\alpha^{-1}}\times100, \text{ and } R_s/R_v \text{ satisfies} \quad (5)$$

$$\frac{\tau}{\tau-\varepsilon+0.14} < \frac{R_s}{R_v} < \frac{\tau}{\tau-\varepsilon-0.14}, \text{ wherein} \quad (6)$$

D is a distance from the center of the effective picture area (origin) to a diagonal edge of the effective picture area;

H is one half of a long side of the effective picture area;

V is one half of a short side of the effective picture area;

α is an aspect ratio V/H of the effective picture area;

$R_d$ is a curvature radius of a cross-section through a diagonal axis of the effective picture area, and $\theta_D$ is a deflection half angle.

10. The cathode ray tube device according to claim 9, wherein $R_d$=$R_v$.

* * * * *